United States Patent [19]

Marchetti

[11] Patent Number: 4,936,945

[45] Date of Patent: Jun. 26, 1990

[54] TAPING UNIT FOR CARDBOARD CASE TAPING MACHINES WITH AN IMPROVED MOVEMENT FOR THE RETURN OF THE ENTRY APPLICATION ROLLER

[76] Inventor: Augusto Marchetti, Piazza Sicilia, 7 - 20146 Milano, Italy

[21] Appl. No.: 293,517

[22] Filed: Jan. 5, 1989

[30] Foreign Application Priority Data

Nov. 4, 1988 [IT] Italy ..... 22495 A/88

[51] Int. Cl.[5] ..... B65B 51/06; B65C 1/04

[52] U.S. Cl. ..... 156/468; 156/486; 156/522; 53/137; 493/117

[58] Field of Search ..... 156/468, 486, 522; 53/137; 493/117

[56] References Cited

U.S. PATENT DOCUMENTS

| | | | |
|---|---|---|---|
| 2,596,158 | 5/1952 | Lindsey | 156/522 |
| 2,684,240 | 7/1954 | Lindsey | 156/522 |
| 2,799,419 | 7/1957 | Scheib | 156/522 |
| 3,915,786 | 10/1975 | Collett et al. | 156/522 |
| 4,590,736 | 5/1986 | Marchetti | 156/468 |
| 4,592,188 | 6/1986 | Marchetti | 156/468 |

FOREIGN PATENT DOCUMENTS

| | | |
|---|---|---|
| 2029421 | 10/1970 | France . |
| 1176999 | 10/1984 | Italy . |

*Primary Examiner*—Caleb Weston

*Attorney, Agent, or Firm*—Cushman, Darby & Cushman

[57] ABSTRACT

The taping unit includes a supporting frame, structure for the delivery of the adhesive tape, an entry application roller and an exit application roller movable between an extracted or at rest position and a retracted position, and a tape cutter. The entry application roller is mounted on a mobile support, which is engaged with a guide contained within the outline of the frame of the taping unit and conformed so as to move the entry roller along a circular path with its center positioned outside the frame. The guide is are preferably constituted by a fixed pivot slidably engaged in a shaped slot of the mobile support and by a connection pivot between the same mobile support and an arm rotatable on a fixed axis.

10 Claims, 8 Drawing Sheets

TAPING UNIT FOR CARDBOARD CASE TAPING MACHINES WITH AN IMPROVED MOVEMENT FOR THE RETURN OF THE ENTRY APPLICATION ROLLER

BACKGROUND OF THE INVENTION

The present invention relates to a taping unit for cardboard case taping machines with an improved movement for the return of the entry application roller.

The term "taping unit" relates to those automatic machines which execute the application of lengths of adhesive tape on the top and bottom walls (and in part on the leading and trailing vertical ones) of parellelepiped cardboard cases which are made to progress along a predetermined operating path.

In such machines the "taping units" are the particular mechanisms (usually two per machine, or lower and one upper) used for the delivery of the tape and for its adhesion to the case walls.

Known taping units generally comprise a support frame to be inserted in a suitable space of the taping machine, delivery means for the adhesive tape, an entry application roller for the application of the tape on a short vertical part of the leading wall of the case and along the entire bottom or top wall (according as to whether the taping unit is fitted to the bottom or to the top) of the case, an exit application roller for the application of the tape on a short vertical part of the trailing wall of the case and a cutting blade for the separation of the desired length of tape from a continuous roll which may be used for several operations.

The two application rollers move between an extracted or at rest position in which they protrude from the outline of the frame of the taping unit so that they are inserted in the progress path of the case and a retracted position in which the rollers are included completely within the outline of the frame so as to allow the progress of the case itself.

The displacement of the entry application roller from the extracted position to the retracted position is determined by the engagement of the leading wall of the case with the roller itself, which is forced by the above leading wall to move progressively along a retracted path which will allow it to simultaneously apply the adhesive tape to the leading wall of the case. Once retracted, and while the case continues to progress the same entry roller then continues the application of the tape along the bottom or top wall of the case.

The similar movement of the exit application roller can, in turn, be controlled autonomously, but still by the engagement with the progressing case, and it may also be the direct and compulsory consequence of the retraction movement of the entry roller.

The return movement of the two application rollers to the extracted position is subsequently determined by the disengagement of the case from the rollers themselves in combination with the pushing action of suitable elastic means. During such return movement, the exit roller makes the tape adhere to the trailing wall of the case.

Of particular interest is the return movement of the entry application roller, which must occur so as to ensure the correct application of the tape to the leading wall of the case with a suitable passage over the critical point represented by the jointing edge between the above leading wall and the adjacent bottom or top wall, where there are also present the ends of the folded side flaps which ensure the closing of the case and where it is possible that the ends side flap can be turned over. At the same time, the return movement of the entry roller must be such as not to damage the case, in particular, again, at the above edge. In other words, the movement must be executed so that the tape is forced sufficiently firmly against the case, but also so as to avoid resistances greater than those which the case itself may sustain.

A known system for the return of the entry roller provides for the roller to be freely supported in a rotatable way by an arm pivoted on a fixed axis included within the outline of the frame of the taping unit and next to the latter's entry end, so that the roller follows a path of an arc of a circle which is convex towards the outside.

This known system has the disadvantage that, so as not to substantially increase the size of the taping unit, the entry roller support arm is necessarily somewhat short and determines an entry angle of the roller within the outline of the frame, which angle is fairly substantial. This causes an undesirable resistance at the most delicate point of the case, that is at the abovementioned jointing edge between the leading wall and either the bottom or the top wall.

Another known system invented so as to overcome the above disadvantage has the entry application roller mounted on a support arm which is movable along an oblique rectilinear guide so as to follow a rectilinear path with, component in the direction of the progess of the case. This solves the problems related to the resistance and to the entry angle, but makes it inevitable to use a frame of larger dimensions, so as to accommodate the long stroke of the roller retraction. In addition, again as a result of the length of the retraction stroke, the problem is created of accompanying and recovering the tape when the roller performs the roller retraction movement.

SUMMARY OF THE INVENTION

An object of the present invention is to provide a taping unit with an entry application roller retraction system which overcomes the disadvantages of the abovementioned known systems, allowing a suitable limitation of the forces required and of the entry angle without, however, having to increase the size of the outline of the taping unit and at the same time creating problems in relation to accompanying and recovering the tape.

According to the invention, such object is achieved with a taping unit of the type comprising a supporting frame, delivery means for the adhesive tape, an entry application roller and an exit application roller which can be moved between an extracted or at rest position in which they protrude from the outline of the frame of the taping unit so that they are inserted in the progress path of the case and a retracted position in which they are included completely within the outline of the frame so as to allow the progress of the case itself, and cutting means for the separation of the desired length of tape to be applied to the progressing case, characterized in that said entry application roller is mounted on a movable support engaged with guiding means contained within the outline of said frame and conformed so as to move said entry roller along a circular path with its centre outside said frame.

In this way, without changing the usual outline of the taping unit, it is possible to impart a wide-radius circular movement to the entry roller, whereby it is possible to reduce the forces required and to have the most suitable entry angle. Any possible damage to the box is thus avoided, and the passage over the critical edge between the leading wall and either the bottom or the top wall of the case is avoided. By suitably selecting the amplitude and the curvature of the retraction path, it is, on the other hand, possible to avoid the occurrence of problems related to the accompaniment and recovery of the tape.

A first possibility is that the guide means be selected so as to determine a circular path with its centre upstream from the entry end of the taping unit and displaced in a direction opposite to that in which the entry roller protrudes with respect to the surface on which the case is placed on the taping unit frame. Such circular path is thus convex towards the outside of the unit which may otherwise be, as described in the known art referred to above.

A second, more innovative possibility is that the guide means be selected instead so as to determine a circular path with its centre downstream from the entry end of the taping unit and displaced in a direction which is the same as that in which the entry roller protrudes with respect to the plane where the case is placed on the taping unit frame. A circular path is thus obtained which is convex towards the inside of the unit, that is which is concave towards the outside of the unit itself. The situation is thus inverted with respect to the known art and permits the achievement of a much reduced entry angle and such as to obtain a smooth passage over the cases's edge, so that the drawback is appreciably reduced of turning over the side flaps of the bottom or top of the case at the moment of the passage over the jointing edge between the leading wall and either the bottom or the top of the case itself.

In both embodiments, a further possible improvement is achievable by conforming the guide means so that the circular path determined by them ends with its last section at a greater vertical angle. In this way, it is possible for the entry roller to pass more rapidly over the case's edge, while it does not create any problem of forces, because the entry roller at that point has already engaged the bottom or the top wall of the case.

Various types of guide means may be used to determine the desired movement with circular path of the entry roller. Those currently preferred derive from commonly assigned Italian patent No. 1176999 and consist of a fixed pivot slidably engaged in a suitably shaped slot of the entry roller's mobile support and in a connecting pivot between the same mobile support and an arm rotating on a fixed axis included within the outline of the taping unit's frame and next to the exit end of the frame itself. With this guide system, the inlet roller support, and therefore the inlet roller itself, may be made to move along any path which depends on the shape of the guide slot and, with an appropriate selection of the latter, may indeed become circular, with its center outside the frame, as achieved by the present invention.

DESCRIPTION OF THE DRAWINGS

Examples of the use of such guide means to determine the path of the entry roller according to the present invention are illustrated for purposes of demonstration, but not as a limitation, in the accompanying drawings, in which.

DETAILED DESCRIPTION

Figure 1:
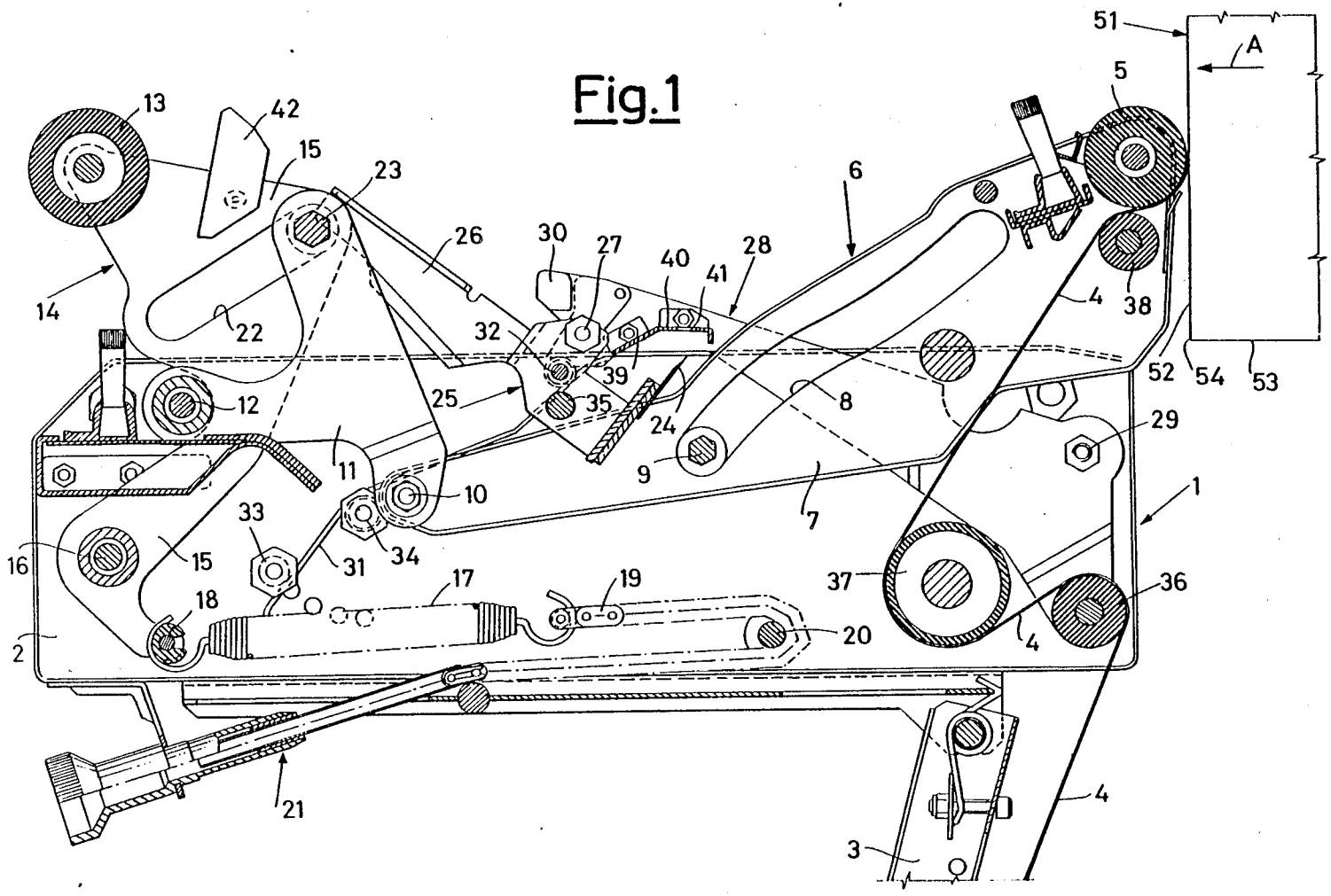
FIG. 1 is a longitudinal section of the taping unit according to the invention, with the entry and exit application rollers in the extracted or at rest position.
Figure 2:
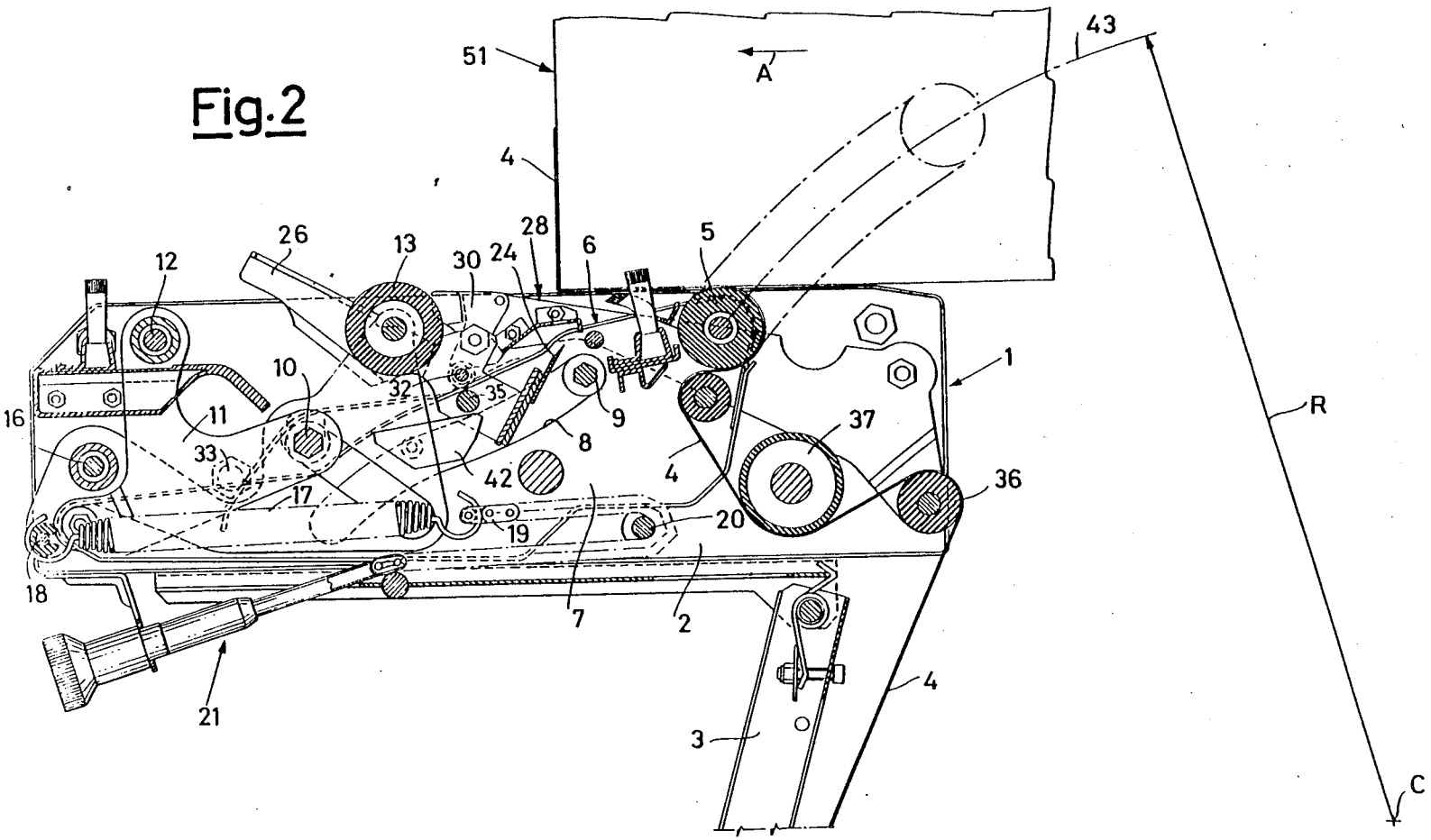
FIG. 2 shows the same taping unit illustrated in FIG. 1 with the application rollers in the retracted position.

FIGS. 1 and 2 show a taping unit according to the invention, suitable for the application of adhesive tape along the bottom wall and along part of the leading and trailing walls of parellelepiped cardboard cases which is made to progress from right to left according to the arrows A shown in the above figures. The same taping unit, turned upside down, will, however, be utilized for the application of adhesive tape along the top wall and along part of the leading and trailing walls of the same or a similar case.

The taping unit of FIGS. 1 and 2 is generally of the type described in the Italian patent No. 1176999 from which U.S. Pat. Nos. 4,590,736 and 4,592,188 (also commonly assigned herewith) claim priority, and, whose description is herein incorporated for any minor details, and comprises a support frame 1 formed according to the known art by parallel vertical sides 2 rigidly connected together. From the frame 1 an arm 3 extends downwards for the support and withdrawal of an adhesive tape 4 from a conventional roll (not shown) which may be used for several taping operations.

The frame 1 supports the taping members and the appropriate driving mechanisms.

A first taping member is constituted by an entry application roller 5, which is supported in a freely rotatable way by a mobile support 6 formed by a pair of parallel shoulders 7 rigidly constrained together. The two shoulders 7 have identical shaped slots 8, in which a fixed pivot 9 is slidably engaged. A connecting pivot 10 also achieves a pivoting constraint between the two shoulders 7 and one end of a T-arm 11 with central stem rotatable on a fixed pivot 12.

A second taping member is constituted by an exit application roller 13, which is supported in a freely rotatable way by another mobile support 14 formed by a pair of parallel levers 15 rigidly constrained together. The two levers 15 are pivoted on a fixed pivot 16 and held in the at rest position of FIG. 1 by a helical spring 17, of which one end is attached to an end pin 18 of the levers 15 and the other end is attached to the corresponding end of a chain 19 connected at 20 to an adjustment mechanism 21, which by means of the position of chain 20 adjusts the tension of the spring 17. The two levers 15 also have equal transverse slots 22, in which a pin 23 is slidably engaged supported by the other end of the T-arm 11. Between the two levers 15 there is positioned and fixed a small trapezoidal-shaped block 42, whose purposes will be explained later.

There is also a cutting blade 24 supported, in an intermediate position between the two application rollers 5 and 13, by a pair of levers 25, which have a drive portion 26 and are pivoted at 27 on a second pair of levers 28 pivoted on a fixed pivot 29 and equipped with a drive portion 30. On the levers 25, and thus also on the levers 28, a wire spring 31 acts, which at one end is fastened at 32 to the levers 25 and which goes on to another end fastened to an adjustable retainer 33, further passing over intermediate elements 34 and 35, of which the first of fixed and other is supported by the levers 25.

There are lastly also delivery means of the adhesive tape, which take the adhesive tape 4 from the delivery reel (not shown) up to the inlet application roller 5 with the adhesive face towards the leading face of the arriving case. The above delivery means comprise an intermediate roller 36 rotatably supported by the pair of levers 28, an intermediate roller 37 rotatably supported by the frame 1 and an intermediate roller 38 rotatably supported by the mobile support 6.

In the at rest position the spring 17 keeps the exit application roller 13 in the extracted position of FIG. 1, in which the roller itself is inserted in the progressing path of a case 51, of which 52 indicates the leading vertical wall, 53 indicates the bottom wall (actually consisting of the end flaps and side flaps conventionally folded in the closed position) which will come up against the top of the parallel shoulders 2 of the frame 1, and 54 indicates the jointing edge between the leading wall 52 and the bottom wall 53.

Consequently, due to the constraint achieved by the T-arm 11, the extracted position is also maintained for the entry application roller 5, on whose cylindrical wall the free end of the adhesive tape 4 has been previously positioned according to the known art.

The spring 31, in turn, keeps the two pairs of levers 25 and 28 in the position illustrated in FIG. 1, with the respective driving portions 26 and 30 outside the outline of the frame 1 and in the progress path of the case 51. The cutting blade 24 is thus within the outline of the frame 1, protected by the cover elements 39 and 40, the second of which is traversed by a slot 41 for the passage of the blade 24 during the tape cutting operation.

The initial engagement of the leading wall 52 of the arriving case (FIG. 1) determines in the first place the adhesion of the free end of the adhesive tape 4 to the same leading wall, after which the progress of the case in the direction of the arrow A determines a progressive retraction movement of the entry application roller 5 within the outline of the frame 1, so as to permit the case's subsequent progress. At the same time, due to the T-arm 11, exit application roller 13 retracts. Once retraction has been completed, the case continues to progress and causes the retraction of the levers 28, so that the taping unit will be in the condition shown in FIG. 2 and the tape 4 will already have been applied to the leading wall and to the initial part of its wall 53 beyond the edge 54.

It should be noted that in the situation shown in FIG. 2, the block 42 fastened to the mobile support 14 of the exit application roller 13 is below the pin 35 which joins the two levers 28 used to support the cutting blade 24. In this way, the exit application roller 13 remains within the outline of the frame 1, and does not thus constitute an obstacle for the further progress of the case, even should the entry application roller 5, coming into contact with the central and more flexible part of the bottom of the case, tend to be partially raised and to drag the exit roller 13 away with it. This is prevented, with the subsequent correct operation of the taping unit also in the case of a yielding case, by the mentioned engagement of the block 42.

Continuing the progress of the case, the latter drags along with it progressively increasing lengths of adhesive tape 4, which the entry application roller 5 causes to adhere to the bottom wall of the case.

When the case encounters the driving portion 26 of the levers 25, the latter rotate, but again not so as to bring the blade 24 into contact with the adhesive tape. The rotation of the levers 25 releases the block 42.

When the bottom wall of the case abandons the driving portion 30 of the levers 28, the spring 31 determines the sharp clockwise rotation of the levers 28 and, due to the engagement of the driving portion 26 with the bottom wall of the case, there is a simultaneous sharp anticlockwise rotation of the levers 25, so that the cutting blade 24 moves sharply through the slot 41 and against the adhesive tape, and the tape is cut.

When the bottom wall of the still progressing case abandons the exit roller 13, this can move sharply towards the extracted position of FIG. 1 under the action of the spring 17, so that, as in the known art, the tap's severed end is caused to adhere to the trailing wall of the case. The entry roller 5 also returns at the same time to the extracted position of FIG. 1, as do the levers 25 and 28 and the cutting blade 24.

The retraction movement of the entry roller 5, previously described, is guided by the engagement of the fixed pivot 9 in the shaped slots 8 of the mobile support 6 in combination with the pivoted achieved by the pivot 10 between the support 6 and the rotating T-arm 11. The path followed by the entry roller 5 is essentially determined by the shape of the slots 8 and in the case of the taping unit shown in FIGS. 1 and 2 is that represented in FIG. 2, that is, an arc of a circle 43 with centre C on the outside of the frame 1, upstream from the latter's entry end and below the surface on which the case 1 is placed on the frame 1.

As shown in FIG. 2, the path in the shape of a circular arc of the entry roller has a large radius of curvature R and is convex upwards and is selected so as to ensure a large lever arm with a small entry angle of the roller, while the outline of the taping unit is not increased as a result of the position of the centre C.

Figure 3:
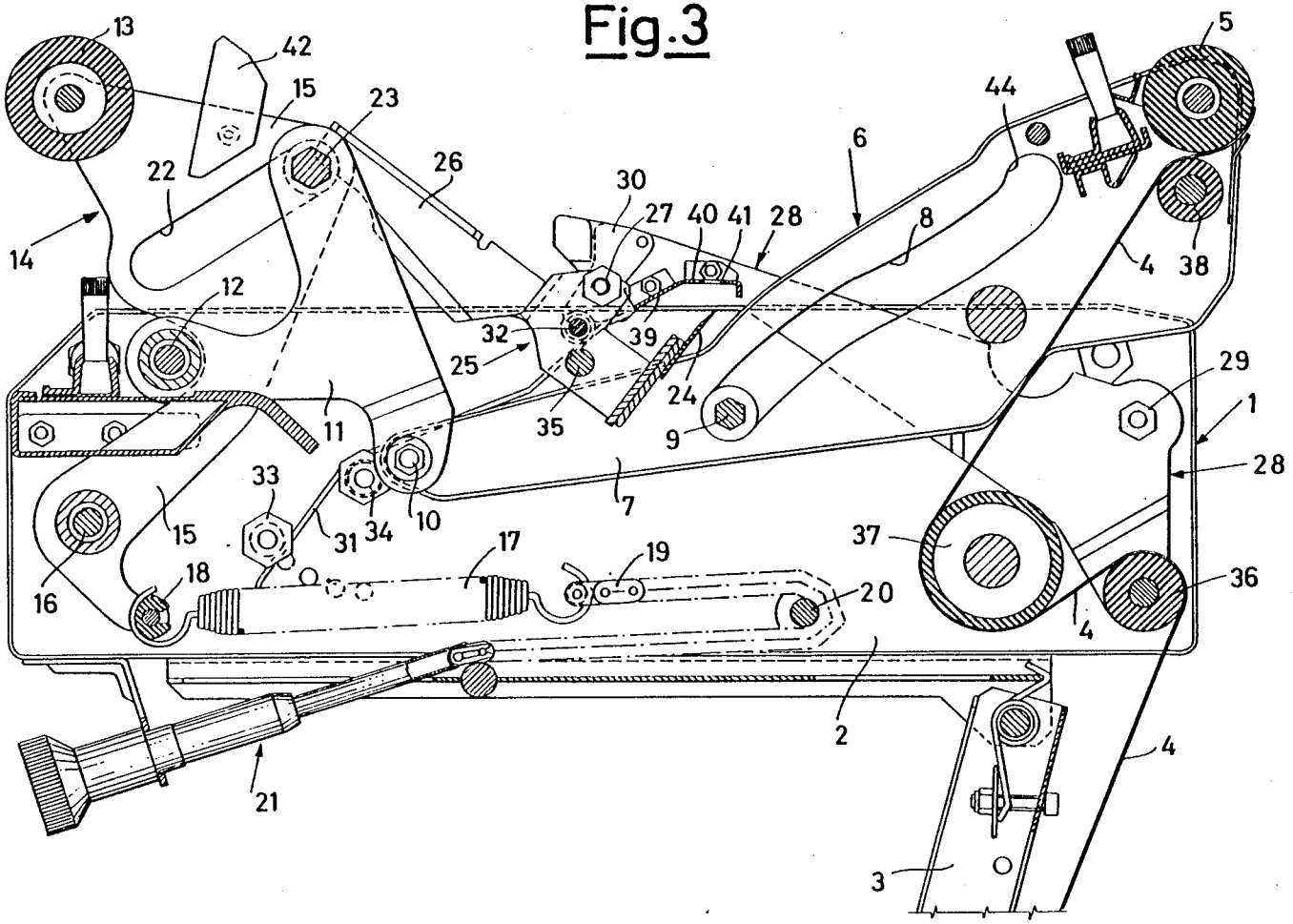
FIG. 3 shows another taping unit according to the invention with the application rollers in the extracted or at rest position.
Figure 4:
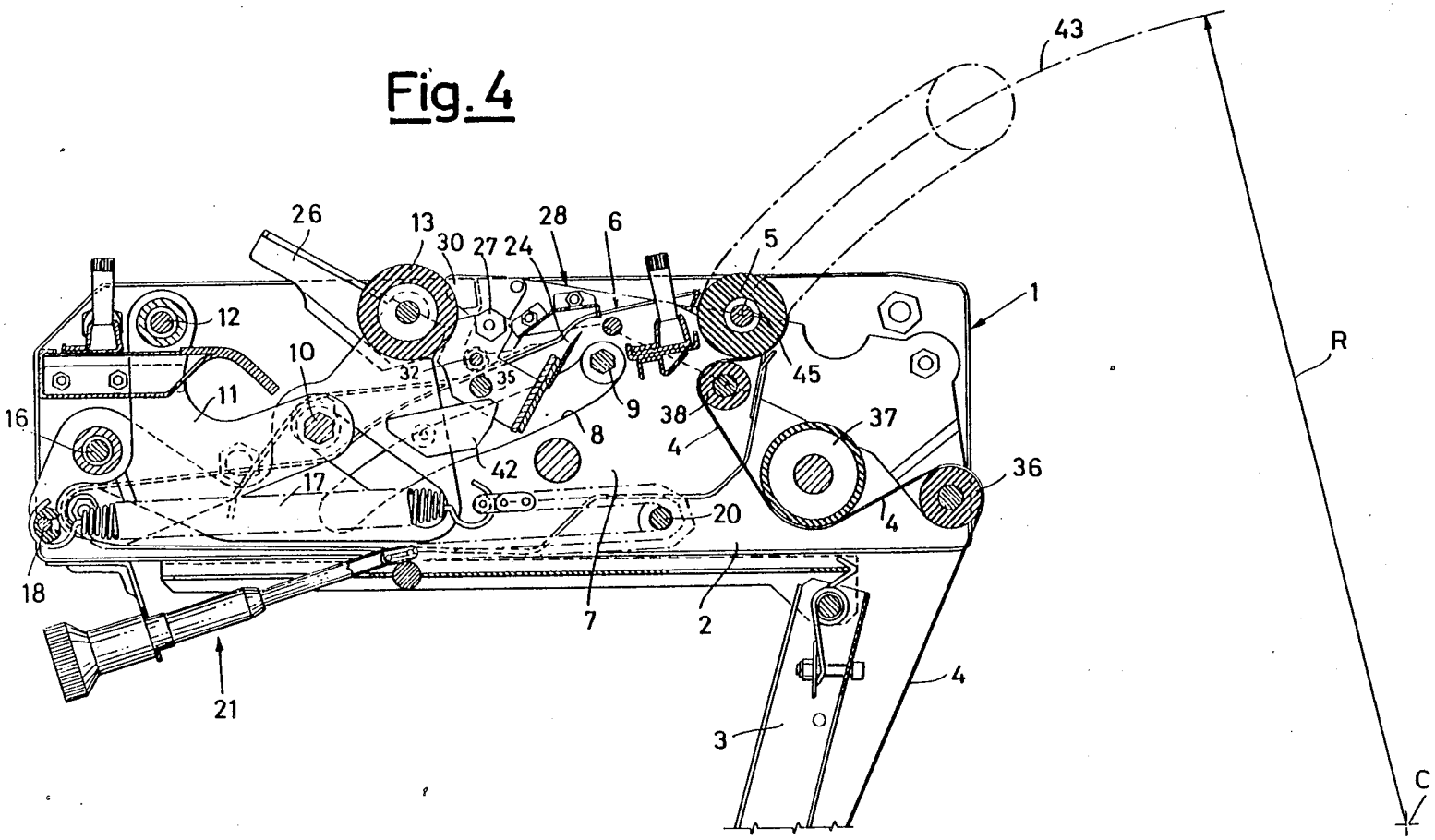
FIG. 4 shows the same taping unit illustrated in FIG. 3 with the application rollers in the retracted position.

If desired, by adding to the slots 8 a reduced terminal portion facing upwards (FIG. 3), it is possible to add to the circular path 43 a final generally vertical section 45 (FIG. 4), which permits a faster final retraction of the entry roller 5 for a correspondingly faster passage over the edge 54. In addition the force exerted on the bottom wall of the case is suitably limited.

Figure 5:
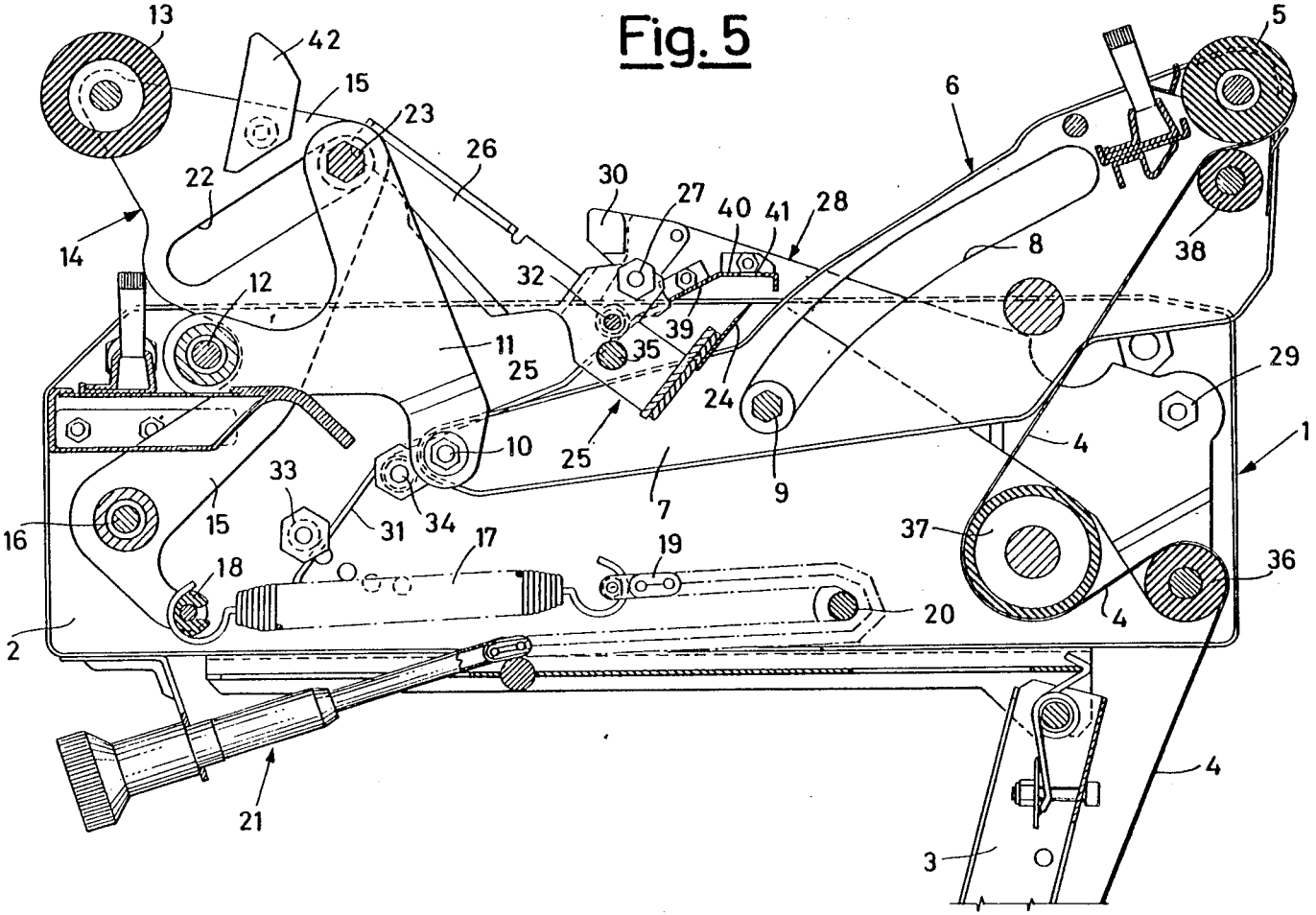
FIG. 5 shows yet another taping unit according to the invention with the application rollers in the extracted or at rest position.
Figure 6:
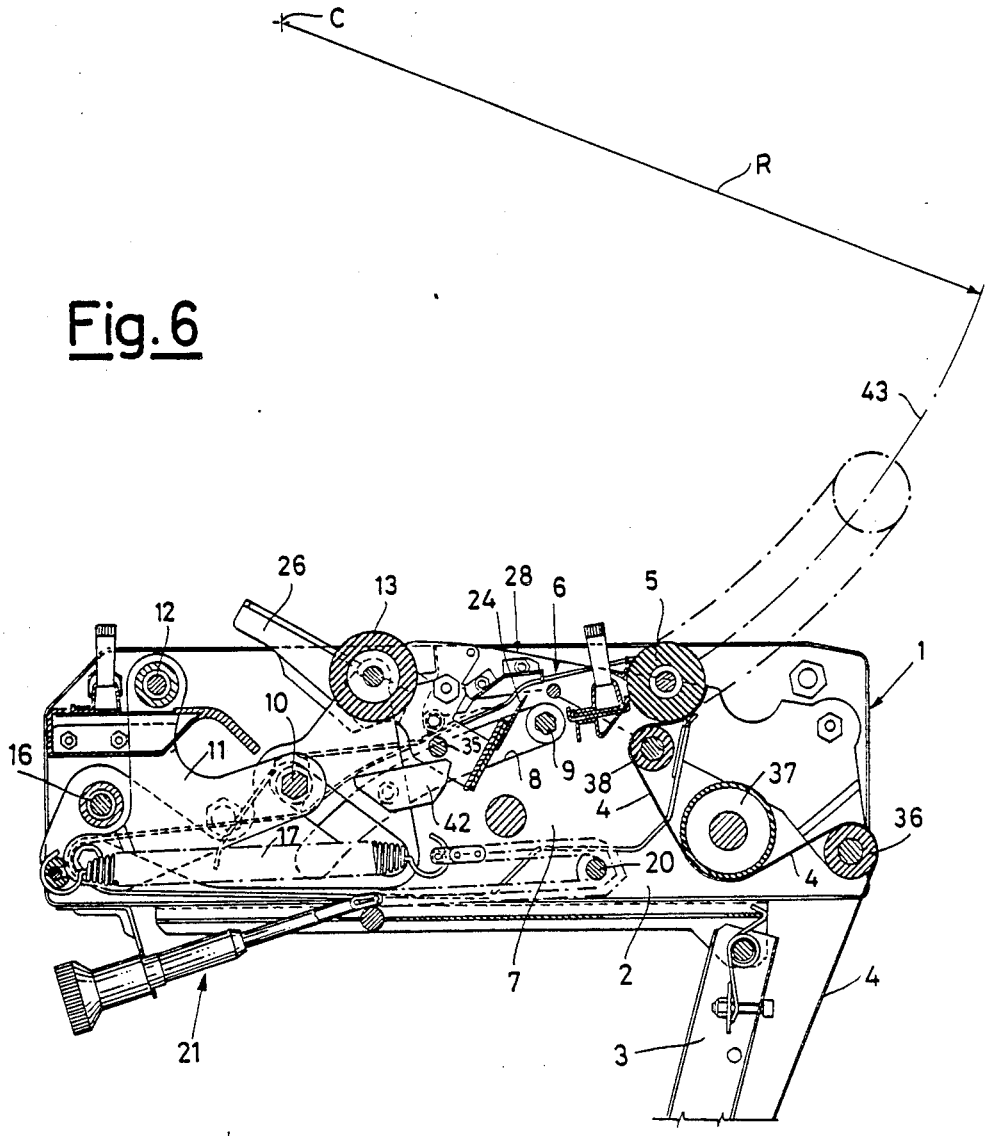
FIG. 6 shows the same taping unit illustrated in FIG. 5 with the application rollers in the retracted position.

As an alternative, the slots 8 may be shaped as shown in FIG. 5, thus determining a path 43 which is still circular with a large radius R, but whose center C is above the surface on which the case is placed and downstream from the entry end of the frame 1 (FIG. 6). This solution has the merit that it determines a very small entry angle of the roller and thus a very smooth passage over the edge 54 of the case, with consequent reduction in the danger of overturning the leading ends of the closing side flaps of the case's bottom.

Figure 7:
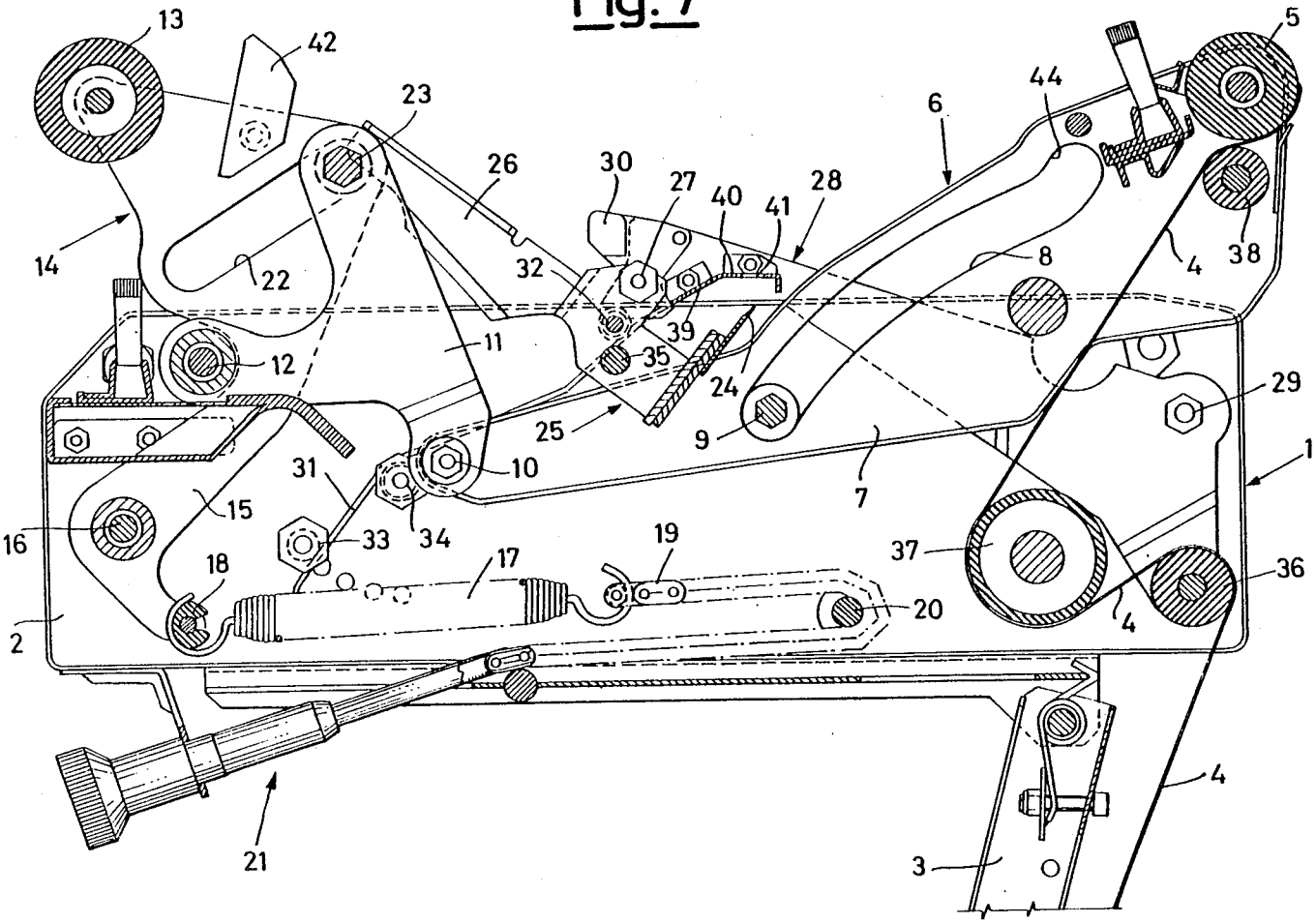
FIG. 7 shows another taping unit according to the invention with the application rollers in the extracted or at rest position.
Figure 8:
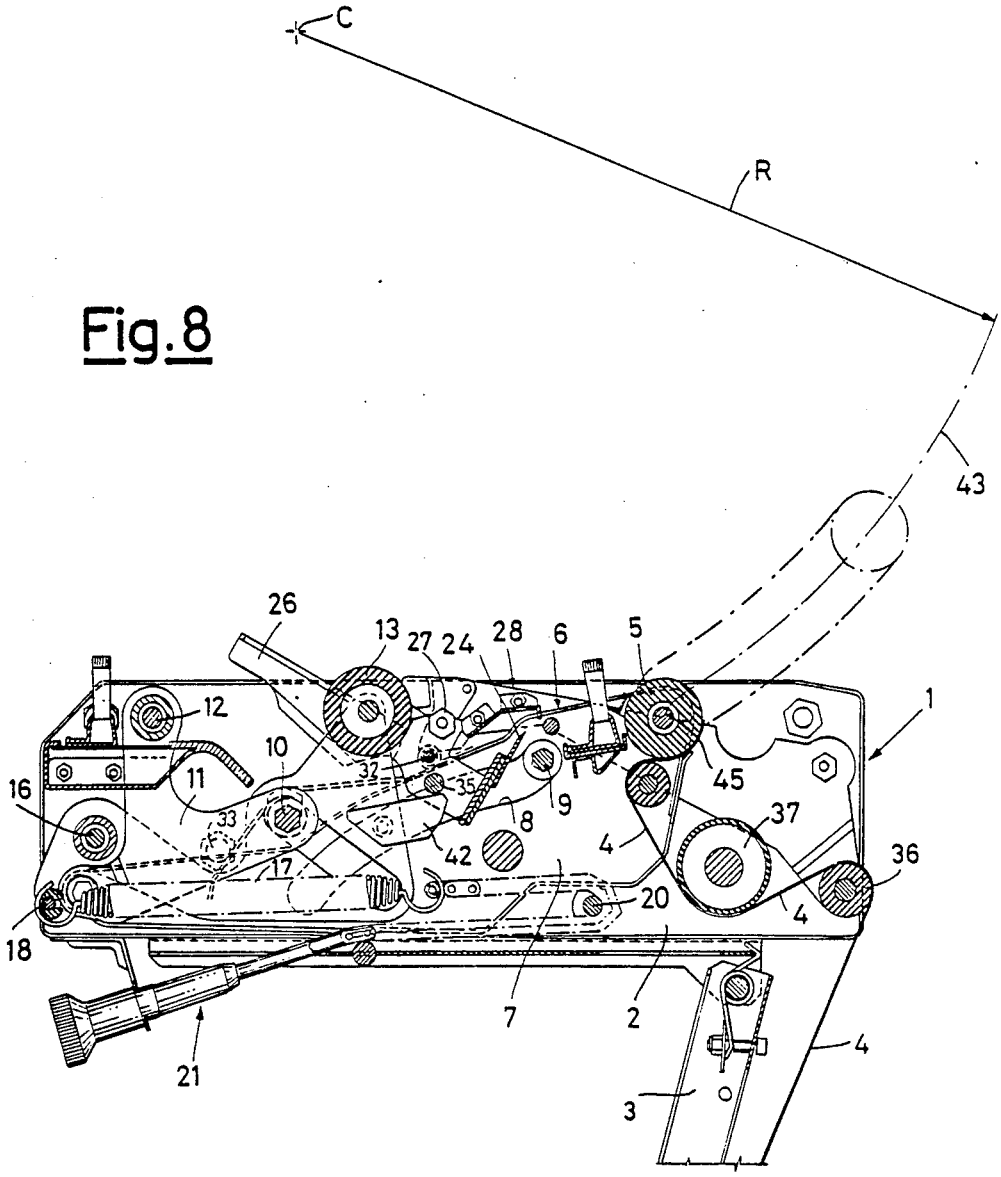
FIG. 8 shows the same taping unit illustrated in FIG. 7 with the application rollers in the retracted position.

Again in this embodiment, the slots 8 may have a terminal portion 44 facing upwards (FIG. 7) with a consequent generally vertical section 45 of the circular path 43 (FIG. 8).

I claim:

1. A taping unit for a cardboard case-taping machine, comprising:

a supporting frame having an outline and an entry end;

means for applying adhesive tape;

an entry application roller and an exit application roller, said entry application roller and exit application roller being mounted for movement between an extracted, at rest position in which said rollers protrude beyond said outline of said supporting frame and into a path of progress of a case to be taped as the case moves along on a surface of the supporting frame, and a retracted position in which said rollers are completely located within said outline of said supporting frame, so as to allow said case to progress along said path;

cutting means for separating from a supply of adhesive tape, a desired length of adhesive tape to be applied to said case while said case progresses along said path;

a mobile support for said entry application roller;

guide means located within said outline of said frame;

said entry application roller being mounted on said mobile support, and said guide means breing configured so as to move said entry application roller along a circularly curved path having a center located outside said frame, as said entry roller moves between said extended, at rest position thereof and said retracted position thereof.

2. The taping unit of claim 1, wherein:

said guide means are configured so that said center of said circularly curved path along which said entry roller moves is located upstream of said entry end of said supporting frame and displaced in a direction opposite to that in which said entry application roller protrudes with respect to said surface when in said extracted, at rest position.

3. The taping unit of claim 2, wherein:

said guide means are configured so as to provide said circularly curved path with a substantially vertical terminal portion.

4. The taping unit of claim 1, wherein:

said guide means are configured so that said center of said circularly curved path along which said entry application roller moves is located downstream from said entry end of said supporting frame and displaced in a direction which is the same as that in which said entry application roller protrudes with respect to said surface when in said extracted, at rest position.

5. The taping unit of claim 4, wherein:

said guide means are configured so as to provide said circularly curved path with a substantially vertical terminal portion.

6. The taping unit of claim 1, wherein:

said guide means comprises:

a fixed pivot slidably engaged in a shaped slot provided in said mobile support, and a connecting pivot provided between said mobile support and an arm which is rotatable on a fixed axis.

7. The taping unit of claim 1, wherein:

said supporting frame has an exit end, and said fixed axis is located within said outline of said supporting frame, adjacent said exit end of said supporting frame.

8. The taping unit of claim 6, wherein:

said slot has a main portion and a terminal portion, said terminal portion being more steeply slanted towards vertical than said main portion, so as to provide said circularly curved path with a substantially vertical terminal portion.

9. The taping unit of claim 6, further comprising:

a second mobile support, having said exit roller mounted thereon;

said second mobile support comprising:

at least one lever arm pivotal on a fixed axis and having a slot having a pivot slidably engaged therein, said pivot being supported by said rotatable arm such that movements of retraction and extraction of said entry application roller are accompanied by corresponding movements of retraction and extraction of said exit application roller.

10. The taping unit of claim 9, further comprising:

a stop block provided on said second mobile support and engageable by said cutting means for keeping said exit application roller in said retracted position thereof for a predetermined period subsequent to corresponding retractioin movement of said entry and exit application rollers.

* * * * *